US008438764B1

(12) United States Patent
Schiffman

(10) Patent No.: US 8,438,764 B1
(45) Date of Patent: May 14, 2013

(54) BEREAVEMENT ARTIFACT

(76) Inventor: Howard Eli Schiffman, Monroe, NY (US)

( * ) Notice: Subject to any disclaimer, the term of this patent is extended or adjusted under 35 U.S.C. 154(b) by 0 days.

(21) Appl. No.: 13/153,628

(22) Filed: Jun. 6, 2011

Related U.S. Application Data

(60) Provisional application No. 61/397,118, filed on Jun. 7, 2010.

(51) Int. Cl.
*G09F 19/00* (2006.01)

(52) U.S. Cl.
USPC ..... 40/124.5

(58) Field of Classification Search ..... 40/124.5; 27/1; 63/1.14, 1.15; 428/3; 206/19
See application file for complete search history.

(56) References Cited

U.S. PATENT DOCUMENTS

| | | | | |
|---|---|---|---|---|
| 3,431,166 | A | 3/1969 | Mizutani et al. | |
| 2006/0289321 | A1 * | 12/2006 | Karfias | 206/413 |
| 2008/0010792 | A1 * | 1/2008 | Pryd-Kakuk | 27/1 |
| 2008/0211362 | A1 * | 9/2008 | Moll et al. | 312/204 |
| 2009/0151392 | A1 * | 6/2009 | Fossas | 63/1.14 |

* cited by examiner

*Primary Examiner* — Joanne Silbermann

(57) ABSTRACT

A bereavement artifact comprising a molded body of any desired shape simulating a religious ornament comprising an object in the form of a cross, rock or tablet or other configuration having a surface or opening therein upon or within which a degradable piece of paper including printed or written words of endearment is located such that when the artifact is exposed to the atmosphere the degradable paper will substantially dissolve or disintegrate upon contact with water over a relatively short time period.

6 Claims, 6 Drawing Sheets

BEREAVEMENT ARTIFACT

FIELD OF THE INVENTION

This invention relates to a bereavement artifact of any desired shape simulating a religious ornament or an object such as a rock for use at a burial site in remembrance of the death of a human or animal.

BACKGROUND OF THE INVENTION

In most religions, upon visiting a gravesite, respect is paid to the departed by placement of an object at the gravesite. The object may be that of a rock or stone which is usually placed at the foot of the gravesite simply to show respect and/or to provide a form of identification of the visit in remembrance of the departed individual or animal. Other natural or environmentally suitable ornaments including flowers may also be placed at the gravesite. However, it is not currently acceptable to leave anything in writing at the gravesite such as a sheet of paper or card with words of endearment since the cemetery frowns upon leaving anything at or near the gravesite which can be blown away and/or may desecrate the cemetery grounds even if secured in place.

The present invention is directed to a bereavement artifact of relatively small size which will simulate a religious ornament or a natural looking rock or stone having a receptacle therein exposed to the atmosphere in which degradable paper or a degradable card in the form of a folded sheet or rolled paper containing words of endearment or a personal message may be placed. The degradable paper or card is composed of a composition causing the paper or card to substantially dissolve or disintegrate when in contact with water through exposure to the atmosphere and the natural elements over a relatively short period of time of generally less than a year. Accordingly, the artifact may be left at a gravesite and will not desecrate the cemetery grounds. The degradable paper or card may include printed subject matter and/or a handwritten personal message from a bereaved person. Space is provided for the bereaved person to leave his or her signature following the handwritten message, if desired.

SUMMARY OF THE INVENTION

The bereavement artifact of the present invention is an article of any desired shape simulating a religious ornament of any kind such as a cross, star of David or a hollow object simulating a natural looking rock or stone which comprises a receptacle exposed to the atmosphere for the placement of degradable paper or card composed of a composition causing the paper or card to substantially dissolve or to disintegrate in the presence of water gradually over time with the paper or card containing words of endearment and/or a handwritten message from a bereaved person. The paper or card may be in the form of a sheet of paper which may be folded up or rolled and is preferably of a composition which comprises fibrous cellulous-glycolic acid which renders it susceptible to decomposition and dissolution when in contact with water over a controlled time period as taught in U.S. Pat. No. 3,431,166 the specification of which is herein incorporated by reference. There are paper compositions presently commercially available which are subject to gradual dissolution and/or disintegration in the presence of water over a relatively short period of time which can be one or more weeks or several months.

The bereavement artifact of the present invention may alternatively be formed into a shaped body having a hollow interior or having a hollow compartment exposed to the atmosphere into which the degradable paper containing words of endearment may be inserted. In yet another embodiment of the present invention the bereavement artifact may be formed into a shaped hollow body comprising at least two sections surrounding an interior compartment into which the degradable paper may be placed. The two sections may detachably interlock to one another or one of the sections may interlock to a tray supported in the interior compartment with the sheet of paper to be placed in the tray. In each embodiment either the interior compartment or tray into which a degradable sheet of foldable paper or degradable card is placed and is in contact with the atmosphere through an opening in the body of the artifact or in either or both of the detachable sections so that the degradable paper communicates with the atmosphere permitting rain water to contact the degradable paper.

BRIEF DESCRIPTION OF THE DRAWINGS

Additional advantages of the present invention will become apparent from the following detailed description of the invention when read in conjunction with the accompanying drawings of which.

DETAIL DESCRIPTION OF THE INVENTION

The bereavement artifact 10 of the present invention is a moldable shaped hollow body of any desired shape, particularly a shape which has religious relevance to any given religion, such as a cross for the Christian religion or a star of David for the Jewish religion or in any other desired shape such as, for example, for simulating a rock or stone. The rock or stone or other artifact shape may be hollow or have an opening for insertion of degradable paper either in the form of a folded or rolled up sheet of paper containing words of endearment or by placement of a label or sticker of degradable paper upon which words of endearment are included.

For purposes of the present invention degradable paper means any conventional paper composition which will entirely or at substantially dissolve or disintegrate when in contact with water through exposure to the atmosphere and/or the natural elements over a relatively short period of time of generally less than a year but preferably a much shorter time period of only weeks or less. An example of degradable paper which will substantially dissolve or disintegrate when in contact with water through exposure to the atmosphere and the natural elements over a relatively short period of time is preferably a paper composition comprising fibrous cellulous-glycolic acid. It is known to those skilled in the paper art that conventional paper which includes fibrous cellulous-glycolic acid renders the paper composition susceptible to decomposition and dissolution when in contact with water over a limited time period as is taught in U.S. Pat. No. 3,431,166 the specification of which is herein incorporated by reference. The fibrous cellulous-glycolic acid is formed in a conventional manner with or without other fibrous materials used for making paper. A sodium or potassium compound may be present when forming the conventional paper web. Another process for preparing paper which will dissolve in water is taught in U.S. Pat. No. 3,034,922 the disclosure of which is also herein incorporated by reference. Other paper compositions are also known to those skilled in the art to enable paper to dissolve or disintegrate when in contact with water through exposure to the atmosphere and the natural elements over a relatively short period of time.

Figure 1:
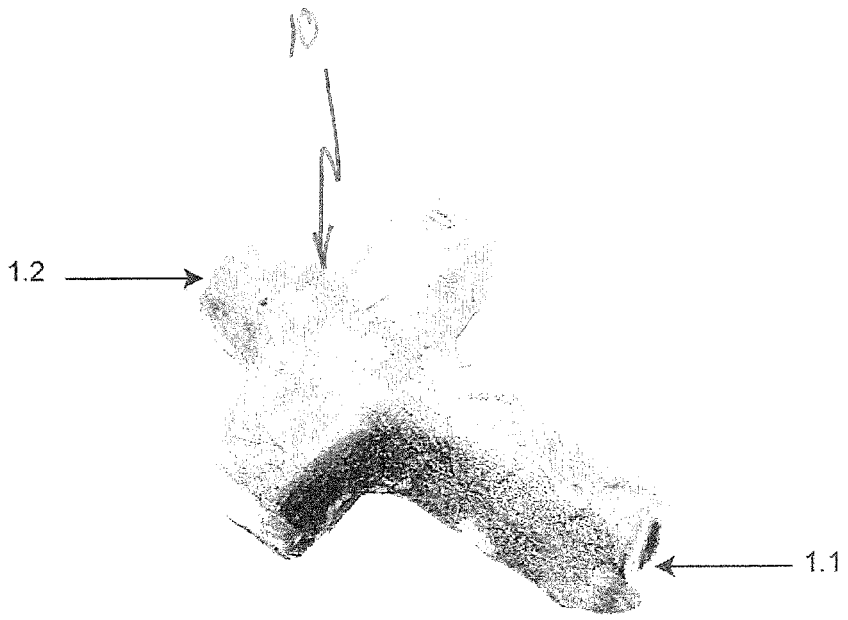
FIG. 1 is a perspective view of a bereavement artifact of the present invention having a shaped body in the form of a religious cross and having a hollow interior section extending from opposite ends adapted for the placement of degradable paper either as a folded or rolled up sheet of paper containing words of endearment.
Figure 2:
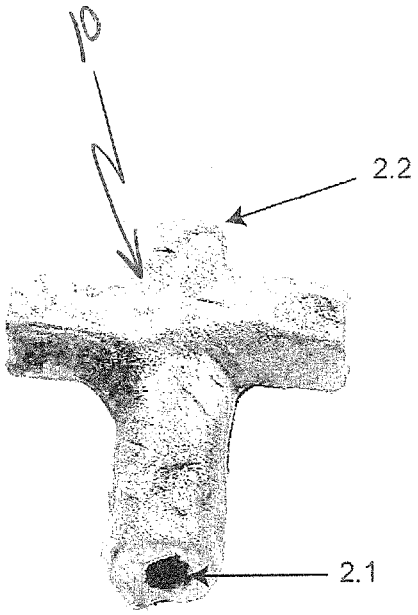
FIG. 2 is a perspective view of the bereavement artifact of FIG. 1 shown in a different position with the shaped body having a non-smooth surface texture simulating a grainy surface.
Figure 11:
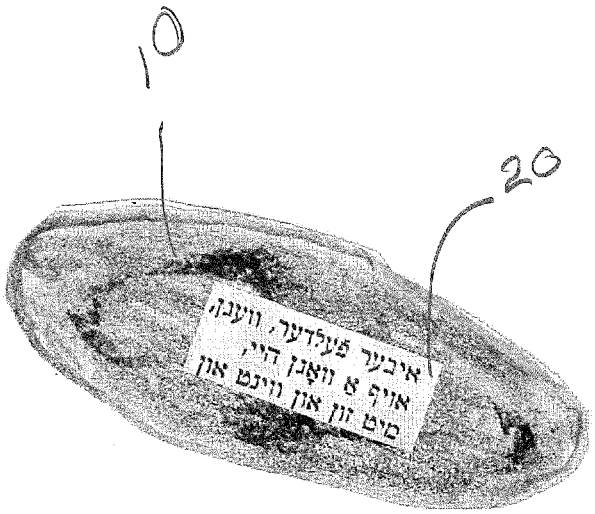
FIG. 11 is another perspective view of the artifact of FIG. 5 showing a label or degradable paper sticker with printed words of endearment, which in this figure are shown in Hebrew, pasted upon one side of the artifact and is representative of a label or sticker which may be placed on the artifact of FIG. 9 or any of the other artifact embodiments of the present invention.

FIGS. 1-7 are perspective views of different embodiments of the bereavement artifact of the present invention. The bereavement artifact 10 in FIG. 1 is shown having a shaped body in the form of a religious cross with a hollow interior extending from one end 1.1 to the opposite end 1.2. A sheet of degradable paper (not shown) is insertable into the hollow interior section from either end 1.1 or 1.2. The degradable sheet of paper may contain printed words of endearment and/or a personal message which may be handwritten on the paper and signed before the paper is folded or rolled up and inserted into the hollow interior of the artifact 10. Alternatively, a label or sticker 20 of degradable paper as shown in FIG. 11 containing words of endearment in any desired language may be attached to the artifact 10 at any desired location. The label or sticker 20 preferably has an adhesive on one side for attachment of the label or sticker to the artifact 10. The adhesive backing on the label or sticker 20 should not impede the ability of the paper to timely disintegrate and may itself be of a composition which will readily dissolve or disintegrate in a short time period.

The degradable paper may have a preprinted message thereon and may be in the form of a sheet or card of any desired size to enable it to be easily inserted into the artifact 10 either in the opening or to be place into a compartment or movable tray within the artifact or attached thereto in the form of a label or sticker of degradable paper. The printed words of endearment may represent a relevant prayer or a message in any desired language such as English, Latin, Hebrew or Arabic or any known language.

The bereavement artifact 10 of the present invention is molded into any desired shaped from a moldable composition of known material(s) comprising gypsum, sand, cement, crushed carbon, fiber glass, cardboard, any cellulous material, mica particles, vinyl, rubber, ceramics, clay, wax and plastic individually or in any desired combination. The molded artifact 10 is preferably molded into a shaped body which is opaque having either a non-smooth surface texture simulating a grainy surface or a smooth surface texture.

Figure 3:
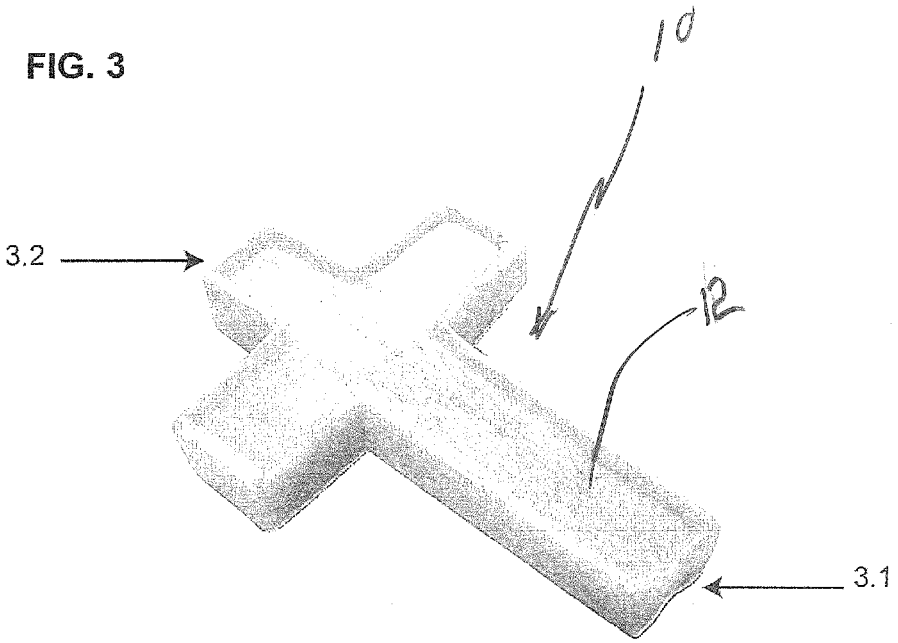
FIG. 3 is another perspective view of the bereavement artifact of FIG. 1 in which the shaped body has a smooth surface texture.
Figure 4:
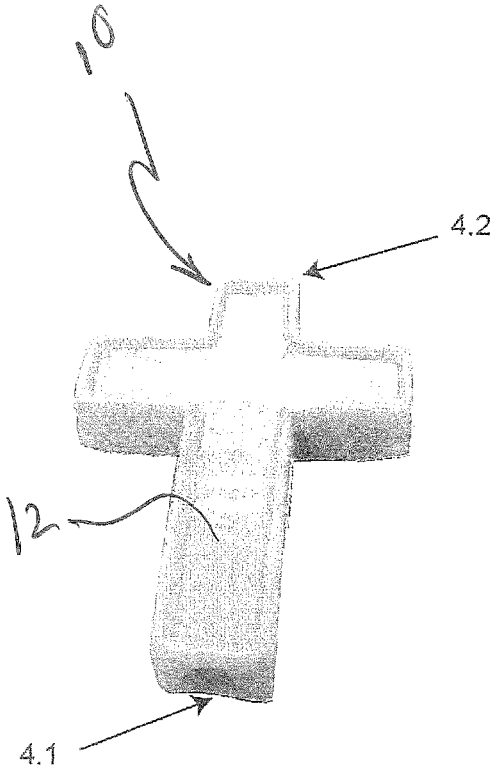
FIG. 4 is a perspective view of the bereavement artifact shown in FIG. 3 oriented in a different position to show the hollow interior section extending from opposite ends for the placement of degradable paper either as a folded or rolled up sheet of paper containing words of endearment.
Figure 5:
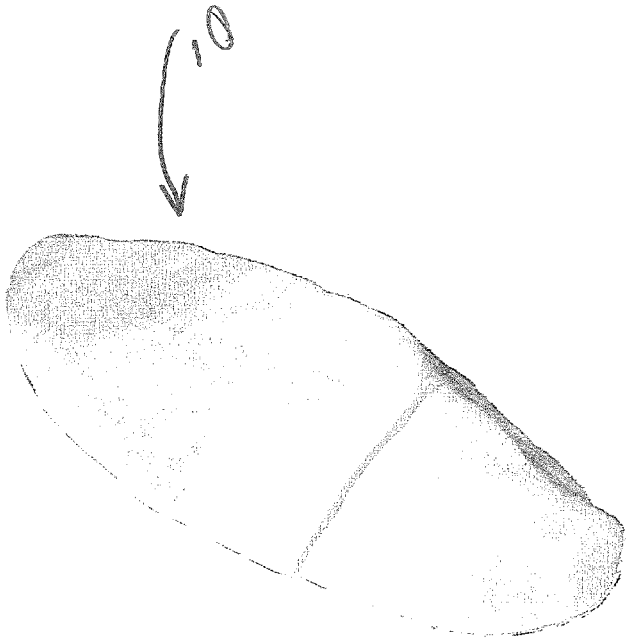
FIG. 5 is a perspective view of another bereavement artifact of the present invention simulating an object such as a natural rock or stone having an opening in the rock (not shown) for the placement of degradable paper either as a folded or rolled up sheet of paper containing words of endearment.
Figure 6:
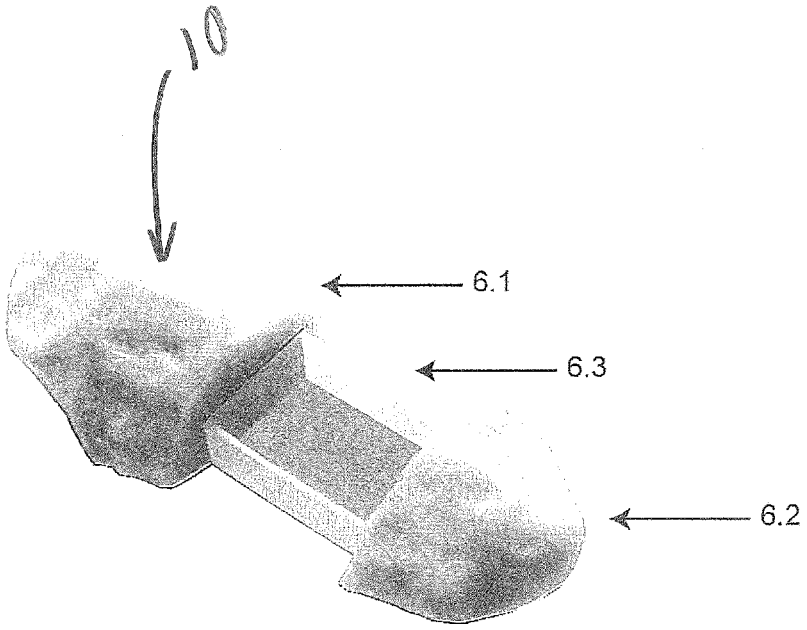
FIG. 6 is a perspective view of the bereavement artifact shown in FIG. 5 having a hollow body with two detachable sections for opening or closing the body and an open tray shown partially extending from one of the sections and being adapted for placement into a hollow compartment in the other section for closing the artifact and with the open tray providing space for inserting degradable paper in the form of a folded or rolled up sheet of paper with printed or written words of endearment thereon.

The bereavement artifact 10 of the present invention is shown in FIGS. 3 and 4 molded into the shape of a cross having a hollow section 12 with open ends 3.1, 3.2 in FIG. 3 and corresponding open ends 4.1 and 4.2 in FIG. 4 respectively. The artifact 10 shown in FIG. 5 may represent a rock having an opening therein (nor shown) for the insertion of degradable paper with words of endearment or for the placement of a label or sticker thereon such as is shown in FIG. 11. FIG. 6 shows an artifact 10 which may be also in the shape of a rock as shown in FIG. 5 having a hollow interior molded to form two detachable sections 6.1 and 6.2 and an open tray 6.3 which extends from the section 6.2 and is adapted to be inserted into the section 6.1 for closing up the artifact after the insertion of degradable paper containing words of endearment.

Figure 7:
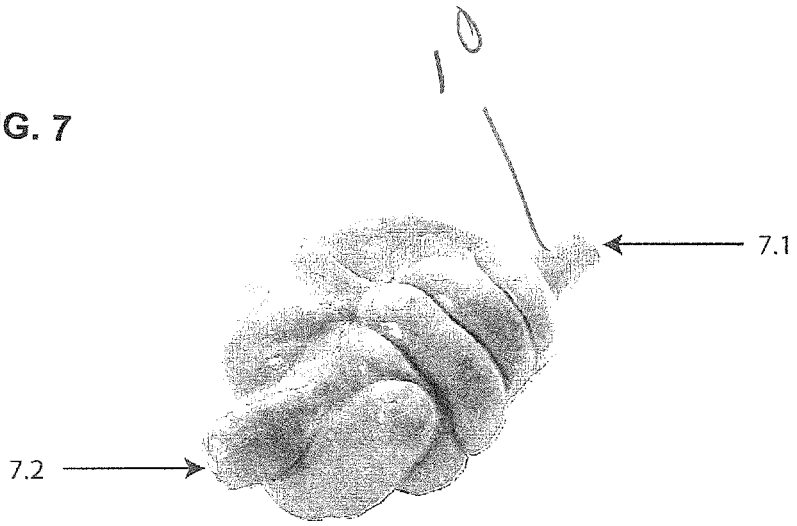
FIG. 7 is a perspective view of another bereavement artifact of the present invention hollow a hollow body into which a folded or rolled up sheet of degradable paper containing words of endearment can be placed with the artifact shown held by a molded hand of a human with the fingers of the hand shown gripping the artifact.
Figure 8:
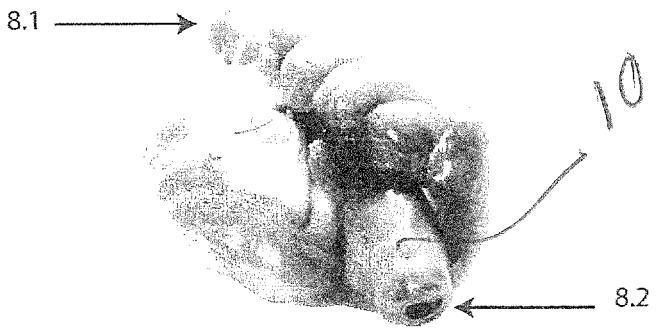
FIG. 8 is a perspective view of the hollow bereavement artifact of FIG. 7 shown oriented in a different position from that shown in FIG. 7.
Figure 9:
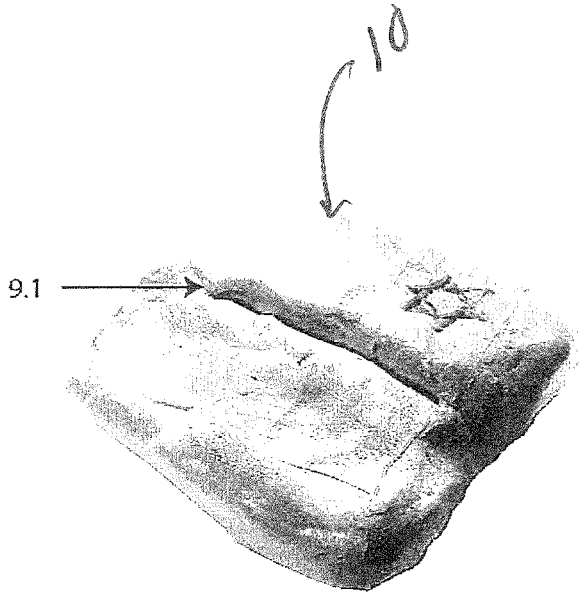
FIG. 9 is a perspective view of another bereavement artifact of the present invention similar to FIG. 5 with the artifact in the shape of a religious tablet displaying the star of David in the Jewish faith and having an opening therein (nor shown) into which a folded or rolled up sheet of degradable paper containing words of endearment can be placed or having a relatively flat surface upon one side, bottom or on the back side thereof (not shown) upon which a label or degradable paper sticker can be placed with printed words of endearment.
Figure 10:
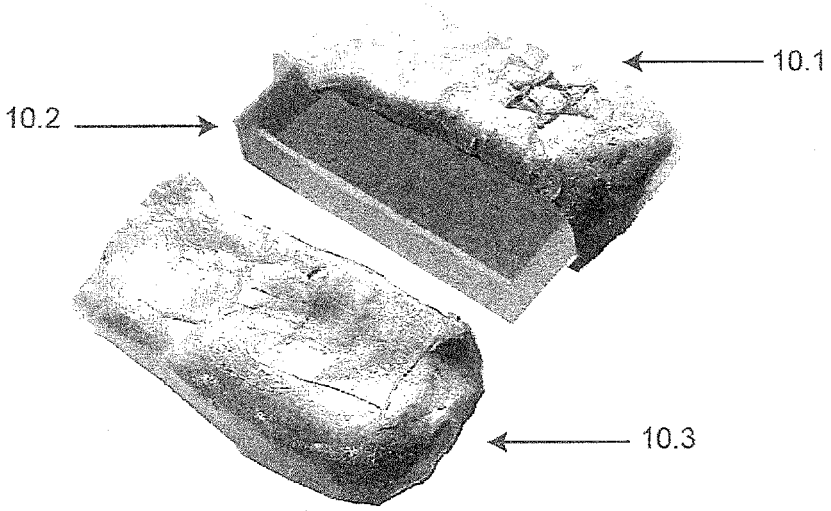
FIG. 10 is another perspective view of the artifact of FIG. 9 shown in the form of two detachable sections spaced apart for exposing an open tray which extends from one of the sections and is adapted for insertion into an open space in the other section of the artifact with the tray adapted for placement of a degradable foldable paper containing words of endearment before closing the detachable sections together.

The artifact 10 may have a smooth or opaque surface texture and may be of any desired shape or geometry illustrative of a religious object in any religion. In FIGS. 7 and 8 an artifact 10 is shown, represented as an elongated hollow object, with open ends 7.1 and 7.2 in FIGS. 7, and 8.1 and 8.2 in FIG. 8, into which degradable paper may be inserted. In FIG. 9 the artifact 10 is shown in the from of a religious tablet with the star of David on one surface and has an opening 9.1 for insertion of degradable paper with words of endearment. An alternative version of the artifact 10 of FIG. 9 is shown in FIG. 10 as a hollow body containing an open tray 10.2 which extends from one slidable section 10.1 for placement into a corresponding hollow compartment of section 10.3 for enclosing the tray 10.2 within the artifact 10 after a sheet of degradable paper containing words of endearment is folded or rolled and inserted into the tray 10.2 and the two sections 10.1 and 10.3 are closed.

FIG. 11 illustrate another way in which degradable paper in the form of a paper label or sticker 20 containing printed or written words of endearment in any desired language may be placed on the artifact 10. The paper label or sticker 20 may have an adhesive on one side thereof to facilitate attachment to the artifact 10 which should be of a composition which will not impede dissolving the paper label or sticker 20 in contact with water upon exposure to the atmosphere during a rainfall and will preferably disintegrate itself. The paper label or sticker 20 without adhesive may constitute the degradable paper for insertion into the artifact 10 in each of the other embodiments and may be folded or rolled up.

The artifact 10 in each of the embodiments of the invention is a small object which can be held in one hand and is no larger than the size of a fist.

What is claimed:

1. A bereavement artifact, in combination with a degradable piece of paper composed of a paper composition containing cellulous-glycolic acid possessing words of endearment or a personal message printed or written on the paper with the combination adapted to be placed at or near a burial gravesite at a location exposing the artifact to the atmosphere, comprising a molded body of any desired shape and/or configuration and further comprising a compartment within which said degradable piece of paper is located for confining said degradable piece of paper within the confines of said compartment with said compartment having an opening in communication with the atmosphere such that while said paper is confined in said compartment it is being simultaneously exposed to the atmosphere to cause the degradable paper to substantially dissolve and disintegrate upon contact with water or water vapor present in the atmosphere over a relatively short time period.

2. A bereavement artifact as defined in claim 1 wherein the artifact is hollow and wherein the opening extends through a section thereof.

3. A bereavement artifact as defined in claim 2 wherein the artifact comprises movable sections having an open tray extending from one section for insertion of the degradable piece of paper.

4. A bereavement artifact of any desired geometry and shape in combination with a degradable piece of paper composed of a paper composition containing cellulous-glycolic acid possessing words of endearment or a personal message printed or written on the paper for placement at or near a burial site to provide remembrance of the person buried at the burial site, with the bereavement artifact comprising a body simulating a religious ornament in a configuration selected from the group consisting of a cross, rock, star, religious figure or tablet and further comprising a compartment within which said degradable piece of paper is located for confining said paper within the confines of said compartment with said compartment having an opening in communication with the atmosphere for simultaneously exposing said degradable paper to the atmosphere such that the degradable paper will begin to dissolve and rapidly disintegrate in contact with water or water vapor in the atmosphere over a finite time period.

5. A bereavement artifact as defined in claim 4 wherein the artifact is hollow and contains at least two detachable sections which detachably interconnect to form the compartment into which the degradable paper is located.

6. A bereavement artifact as defined in claim 5 wherein the two sections manually interlock such that the artifact simulates a single natural looking rock when the sections are interlocked in a closed position.

* * * * *